US009009881B2

(12) United States Patent
Sisk

(10) Patent No.: US 9,009,881 B2
(45) Date of Patent: Apr. 21, 2015

(54) RETAINER ASSEMBLY FOR A SHOWER SURROUND

(75) Inventor: Thomas J. Sisk, Tottenham (CA)

(73) Assignee: Masco Corporation, Taylor, MI (US)

( * ) Notice: Subject to any disclaimer, the term of this patent is extended or adjusted under 35 U.S.C. 154(b) by 898 days.

(21) Appl. No.: 12/574,020

(22) Filed: Oct. 6, 2009

(65) Prior Publication Data

US 2010/0017955 A1 Jan. 28, 2010

Related U.S. Application Data

(62) Division of application No. 10/810,797, filed on Mar. 26, 2004.

(51) Int. Cl.
*A47K 3/34* (2006.01)
*A47K 3/30* (2006.01)

(52) U.S. Cl.
CPC ..... *A47K 3/30* (2013.01)

(58) Field of Classification Search
USPC ..... 4/610, 612–614, 584, 596, 661; 49/43.1, 492.1
See application file for complete search history.

(56) References Cited

U.S. PATENT DOCUMENTS

| | | | | |
|---|---|---|---|---|
| 4,316,295 | A | 2/1982 | Whitney et al. | |
| 4,578,832 | A | 4/1986 | Primucci | |
| 4,671,026 | A | 6/1987 | Wissinger | |
| 4,817,344 | A | 4/1989 | Wissinger | |
| 5,311,707 | A | 5/1994 | LaRoche et al. | |
| 5,799,442 | A | 9/1998 | Takahashi et al. | |
| 6,220,650 | B1 | 4/2001 | Davis et al. | |
| 6,612,074 | B1 * | 9/2003 | Kaye et al. | 49/441 |
| 6,677,020 | B2 | 1/2004 | Dron | |
| 6,691,339 | B1 | 2/2004 | Thomas | |

FOREIGN PATENT DOCUMENTS

| | | |
|---|---|---|
| CA | 1157602 | 11/1983 |

* cited by examiner

*Primary Examiner* — Tuan N Nguyen
(74) *Attorney, Agent, or Firm* — Carlson, Gaskey & Olds

(57) ABSTRACT

A retainer assembly for a shower surround includes a first frame arm, a second frame arm, an arcuate frame section, a stop and a retainer. The arcuate frame section interconnects the first frame arm and the second frame arm. The stop extends from the first frame arm, and is substantially between the first frame arm and the second frame arm. The retainer arm extends from the arcuate frame section in a direction that is generally opposite from the first frame arm and the second frame arm.

12 Claims, 4 Drawing Sheets

RETAINER ASSEMBLY FOR A SHOWER SURROUND

CROSS-REFERENCE TO RELATED APPLICATIONS

This application is a divisional of U.S. patent application Ser. No. 10/810,797, filed Mar. 26, 2004.

BACKGROUND OF THE DISCLOSURE

This disclosure relates to a retainer assembly for a shower surround.

Tub and shower surrounds are positioned within a recess built around a bathtub or shower surround. Conventional modular tub/shower units often include a base portion at the bottom and two or more wall portions. The whole structure is mounted adjacent a wall or corner to form a waterproof surround. The fully enclosed waterproof structure prevents the escape of water into the wall cavity despite the shower spraying water onto the surrounding walls.

One issue that arises with products of this type is that of forming a suitable joint between the surround portions. Various styles of joint have been used, each of which provide particular tradeoffs in complexity, aesthetics, and sealing ability.

Accordingly, it is desirable to provide a waterproof joint between wall portions of a molded plastic shower surround that is uncomplicated and aesthetically pleasing while assuring an effective watertight seal.

SUMMARY OF THE DISCLOSURE

A retainer assembly for a shower surround includes a first frame arm, a second frame arm, an arcuate frame section, a stop and a retainer. The arcuate frame section interconnects the first frame arm and the second frame arm. The stop extends from the first frame arm, and is substantially between the first frame arm and the second frame arm. The retainer arm extends from the arcuate frame section in a direction that is generally opposite from the first frame arm and the second frame arm.

Another retainer assembly for a shower surround includes a first frame arm, a second frame arm and a frame section that interconnects the first frame arm and the second frame arm. A stop extends from the first frame arm. At least one seal is disposed on each of the first frame arm, the second frame arm, and the stop.

BRIEF DESCRIPTION OF THE DRAWINGS

The various features and advantages of this disclosure will become apparent to those skilled in the art from the following detailed description. The drawings that accompany the detailed description can be briefly described as follows.

DETAILED DESCRIPTION OF THE DISCLOSED EMBODIMENTS

Figure 1:
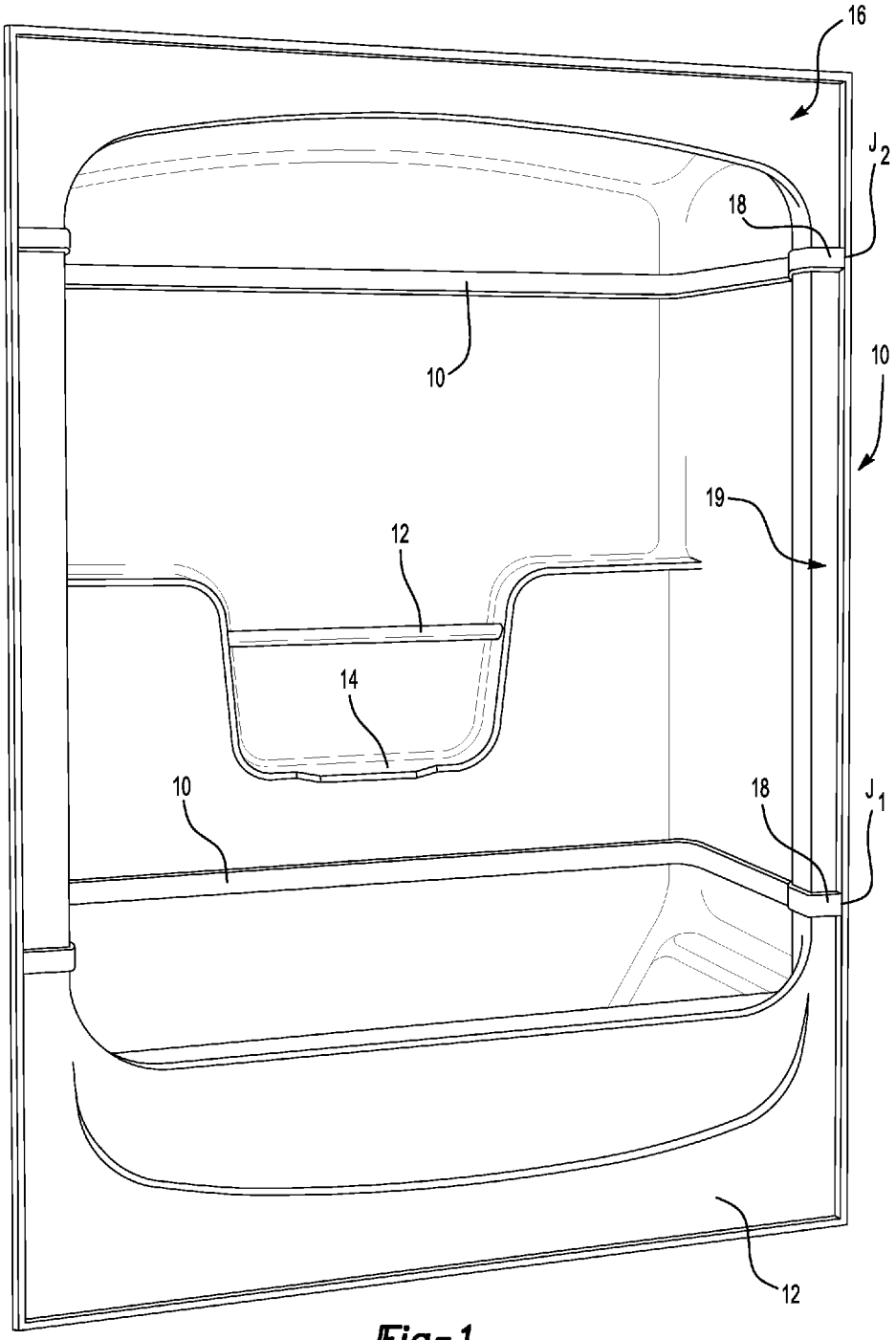
FIG. 1 is a general front view a molded shower surround according to the present disclosure.

FIG. 1 illustrates a general exploded view of a molded shower surround 10. The surround 10 preferably includes a tub section 12, a mid section 14 and a canopy section 16. It should be understood that the term "tub" is not limited to bath tubs only and that relatively shallow shower bases and the like will also benefit from the present disclosure.

The surround 10 is typically formed from an initially uniform thickness acrylic sheet on a vacuum-forming mold. The sections are then separated from the single integrally molded component. The width is that desired for the finished assembly, the height is greater than that desired in the finished assembly by approximately the amount of joint J overlap in the assembled product.

A raised band 18 extends substantially horizontally across the mold between the tub section 12 and the mid section 14, and the mid section 14 and the canopy section 16. That is, the position of the bands 18 will correspond to the desired positions for joints between the surround sections. As will be understood, this disclosure does not require the provision of more than one such band and joint. However, including additional band and joints on the shower surround 10 provides sections having smaller dimensions for ease of ingress/egress through the doors and passages of a house, and also provide a more balanced and pleasing appearance. It is further within the scope of this disclosure to provide that the bands and joints may be of other configurations. Structural and ornamental use of horizontal bands and joints is preferred, and horizontal joints may best utilize the advantages described by this disclosure.

Figure 2A:
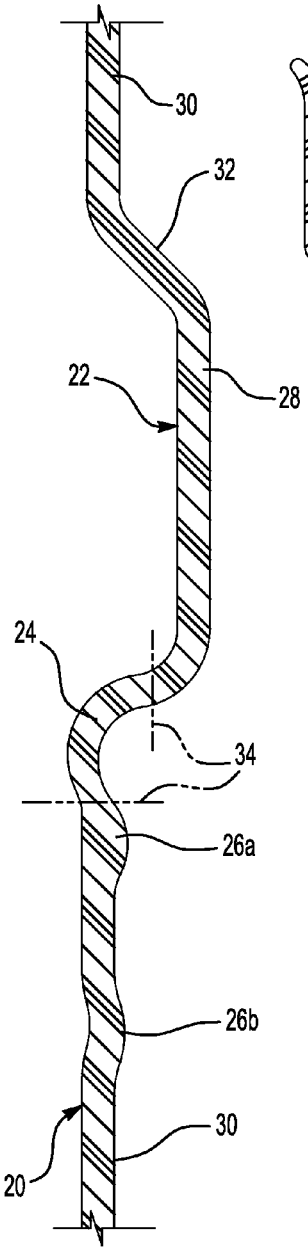
FIG. 2A is an expanded sectional view of a joint section of the molded shower surround prior to separation.

Referring to FIG. 2A, a cross section of the band 18 is illustrated in the original blank prior to separation of the surround sections. Each band 18 includes an inner band section 20, an outer band section 22 and a scrap section 24. The inner band section 20 preferably includes a pair of ribs 26*a*, 26*b*. The ribs 26*a*, 26*b* are raised areas formed in the surround surface 30 and may take various shapes. The outer band section 22 includes a stepped band section 28 which is generally displaced from a surround surface 30 by an angled band section 32. That is, the outer band section 22 is raised from what would otherwise be the continuous surround surface 30 which defines the inner surface of the surround 10. The scrap section 24 is defined by cuts 34 which separate the surround 10 into the sections 12, 14, 16 (FIG. 1).

Figure 2B:
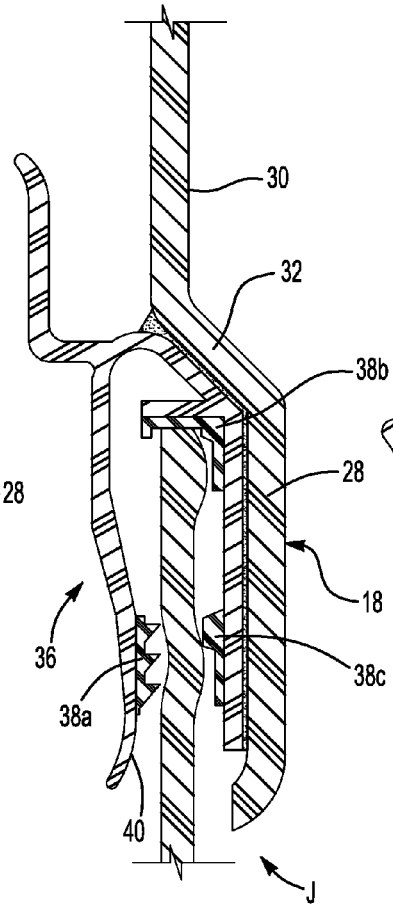
FIG. 2B is an expanded sectional view of a joint section of the molded shower surround in an assembled condition after separation.
Figure 3:
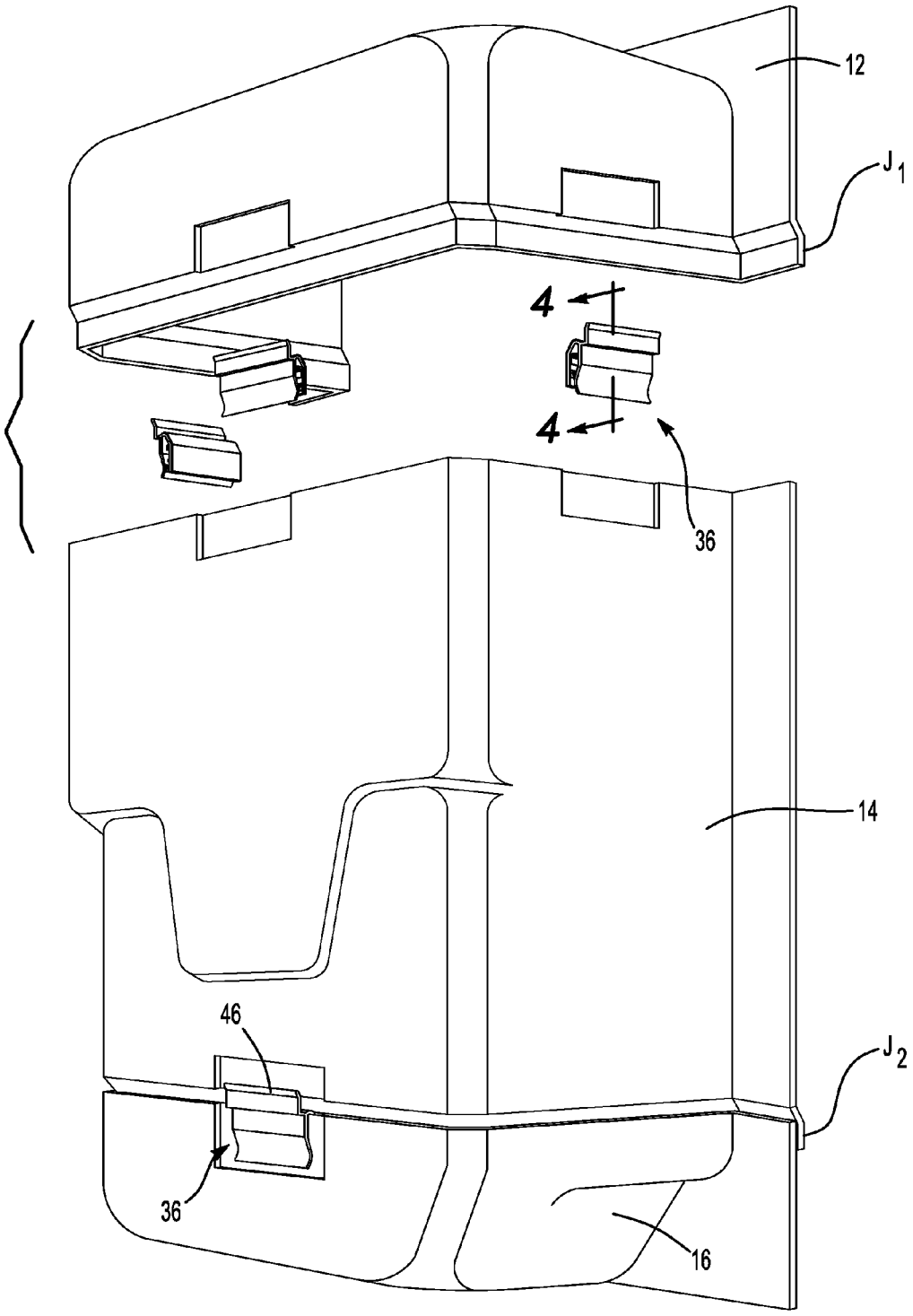
FIG. 3 is an expanded sectional view of a retainer assembly portion taken along the line 3-3 in FIG. 4.

Referring to FIG. 2B, after the cut, a retainer assembly 36 is mounted within the outer band section 22 through an adhesive or the like. The retainer 36 receives the inner band section 20 therein to connect the sections 12, 14, 16 at joints J1, J2 to form the surround (also illustrated in FIG. 3) during installation. In other words, the retainer 36 is mounted to the outer band section 22 which "clips" onto the inner band section 20. Preferably, resilient seals 38*a*, 38*b*, 38*c* are mounted within a retainer frame 40 to form the retainer assembly 36. The seals 38*a*, 38*b*, 38*c* seal the inner surface of the surround 10 from moisture and also minimize noise which may occur should one section 12, 14, 16 be relatively displaced to another section 12, 14, 16 such as by bather within the surround 10.

Figure 4:
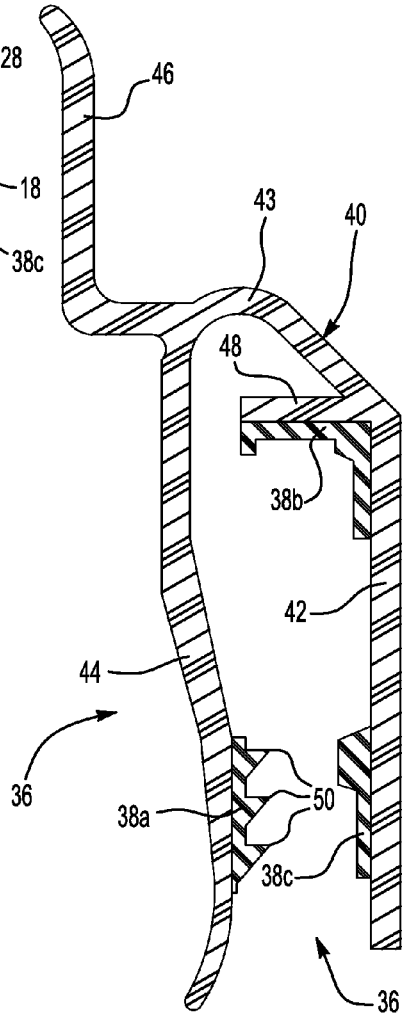
FIG. 4 is a rear perspective view a molded shower surround in an assembled condition.

Referring to FIG. 4, the retainer assembly 36 includes the resilient seals 38*a* 38*b*, 38*c* mounted within retainer frame 40. The resilient seals 38*a*, 38*b*, 38*c* are preferably manufactured of SANTOPRENE rubber and the retainer frame 40 is preferably a molded plastic material, however, other materials will likewise benefit.

The frame 40 generally includes a pair of opposed frame arms 42, 44 which form a generally U-shape. The arm 42 is preferably shaped to be received directly adjacent the outer band section 22 and the angled band section 32. A retainer frame arm 46 extends generally opposite the opposed arms 42, 44. The retainer arm 46 is generally L-shaped and extends from an arcuate frame portion 43 which connects opposed arms 42, 44. A stop 48 extends from the arm 42. The stop 48 is preferably located between and transverse the arms 42, 44. In this example, the stop 48 is a separate and distinct component from the arcuate frame portion 43.

Resilient seals 38*a*, 38*b*, 38*c* are located within the arms 42, 44. Seal 38*a* extends from arm 44 and includes a multiple of wipers 50 which extend toward arcuate frame portion 43. The wipers 50 assist in receiving the inner band section 20 and provide a seal therewith when the surround 10 is assembled (FIG. 4). Although it is not thought necessary in most instances, a gasket or sealing compound rubber may be provided for each joint J. In one example, the seal 38*c* includes a first portion that is contiguous with the stop 48 and a second portion that is contiguous with the frame arm 42.

Figure 5:
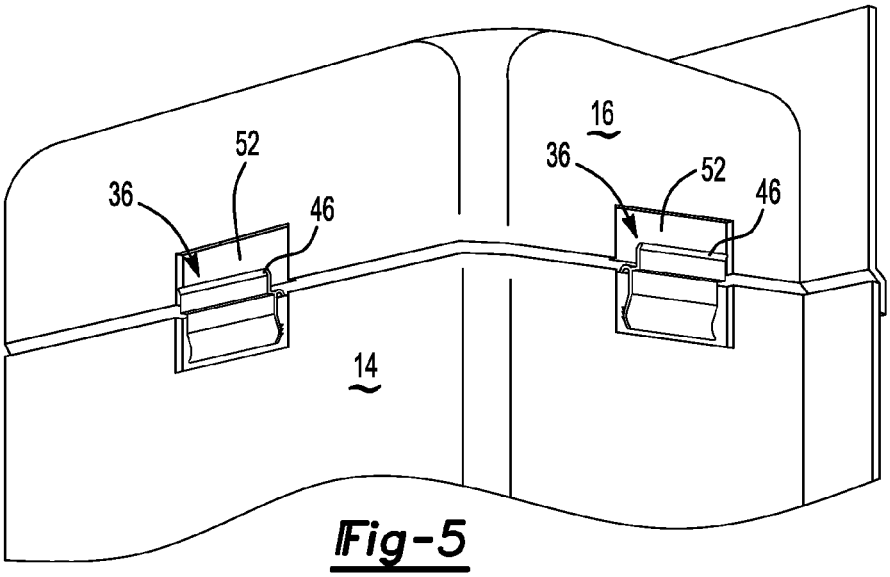
FIG. 5 is an expanded rear view of an upper portion of the shower surround.

Referring to FIG. 5, the retainer assembly 36 are preferably located within recesses 52 formed in the section 12, 14, 16 where the fiberglass and if necessary some of the acrylic is removed from the outward side of the upper section just above the cut 34. The material is removed by grinding, routing, or the like, such that each recess 53 is shaped so that in the overlapped position with the overlapping sections pressed against each other the vertical extents of the upper section above and of the lower section below the bands are approximately co-planar. It should be understood that although the retainer assemblies 36 are disclosed in the illustrated embodiment as essentially straight, other shapes will like wise benefit from the present disclosure.

Figure 6:
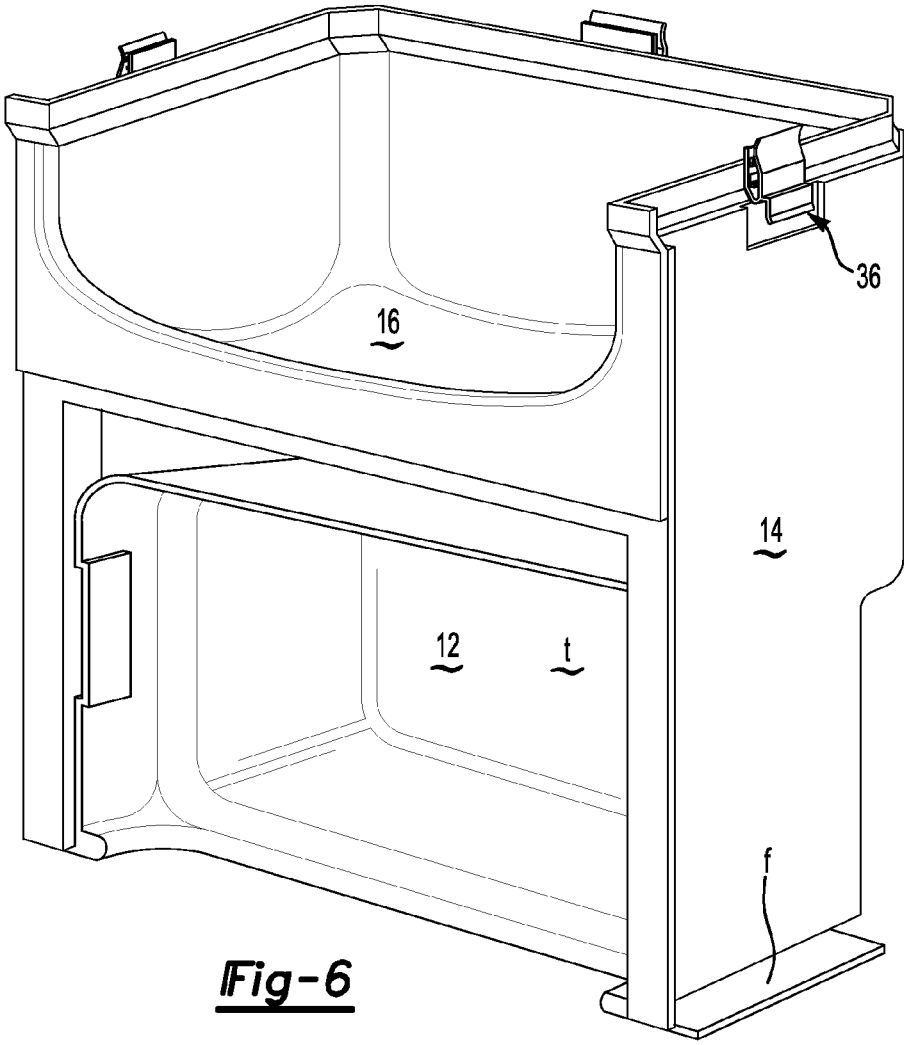
FIG. 6 is a perspective view a molded shower surround in a packaged arrangement condition.

Referring to FIG. 6, the surround 10 is arranged in a packaged arrangement which is conducive to efficient storage and shipment. In the packaged arrangement, the tub section 12 is placed with the apron face down such that the interior of the tub t is outwardly arranged. The depth is approximately 24", which readily permits transport through doorways and the like. Next, the mid section 14 is arranged around the tub section 12 and sits atop the tub section flange f. Finally the canopy section 16 is inverted into the mid section 14 such that the retainer arm 46 faces downward and toward the tub section 12. The retainer arm 46 engages the outer perimeter of the mid section 14 to provide a relatively rigid cubical-shaped unit.

It should be understood that relative positional terms such as "forward," "aft," "upper," "lower," "above," "below," and the like are with reference to the normal operational attitude of the surround and should not be considered otherwise limiting.

It should be understood that although a particular component arrangement is disclosed in the illustrated embodiment, other arrangements will benefit from the instant disclosure.

The foregoing description is exemplary rather than defined by the limitations within. Many modifications and variations of the present disclosure are possible in light of the above teachings. The preferred embodiments of this disclosure have been disclosed, however, one of ordinary skill in the art would recognize that certain modifications would come within the scope of this disclosure. It is, therefore, to be understood that within the scope of the appended claims, the disclosure may be practiced otherwise than as specifically described. For that reason the following claims should be studied to determine the true scope and content of this disclosure.

What is claimed is:

1. A retainer assembly for a shower surround comprising:
a first frame arm;
a second frame arm;
an arcuate frame section that interconnects said first frame arm and said second frame arm;
a stop that extends generally perpendicularly from said first frame arm, said stop substantially between said first frame arm and said second frame arm;
a retainer arm which extends from said arcuate frame section, said retainer arm extends generally opposite said first frame arm and said second frame arm; and
wherein said stop is a separate and distinct component from said arcuate frame section.

2. A retainer assembly for a shower surround, comprising:
a first frame arm;
a second frame arm;
a frame section that interconnects said first frame arm and said second frame arm;
a stop that extends generally perpendicularly from said first frame arm, wherein said stop is spaced radially inwardly from said frame section such that a space extends between said stop and said frame section; and
at least one seal disposed on each of said first frame arm, said second frame arm, and said stop.

3. The retainer assembly as recited in claim 2, wherein said frame section is an arcuate frame section.

4. The retainer assembly as recited in claim 3, wherein said arcuate frame section arcs in a direction generally opposite from said first frame arm and said second frame arm.

5. The retainer assembly as recited in claim 2, wherein said at least one seal includes a plurality of wipers.

6. The retainer assembly as recited in claim 5, wherein each of said plurality of wipers extend generally toward said frame section.

7. The retainer assembly as recited in claim 2, wherein said a least one seal of said stop includes a first portion that is contiguous with said stop and a second portion that is contiguous with said first frame arm.

8. The retainer assembly as recited in claim 2, wherein said first frame arm, said second frame arm and said stop are plastic and said at least one seal is rubber.

9. A retainer assembly for a shower surround comprising;
a first frame arm;
a second frame arm;
an arcuate frame section that interconnects said first frame arm and said second frame arm;
a stop that extends generally perpendicularly from said first frame arm, said stop substantially between said first frame arm and said second frame arm;
a retainer arm which extends from said arcuate frame section, said retainer arm extends generally opposite said first frame arm and said second frame arm; and
wherein said stop is non-contiguous with said second frame arm.

10. The retainer assembly as recited in claim 2, wherein said stop is non-contiguous with said second frame arm.

11. A retainer assembly for a shower surround, comprising:
a first frame arm;
a second frame arm;
a frame section that interconnects said first frame arm and said second frame arm;
a stop that extends from said first frame arm, wherein said stop is non-contiguous with said second frame arm; and wherein a portion of said shower surround extends between said first frame arm and said second frame arm and contacts said stop.

12. The retainer assembly as recited in claim 2, wherein said at least one seal of said stop is L-shaped.

* * * * *